US005215785A

United States Patent [19]

Strasser et al.

[11] Patent Number: 5,215,785

[45] Date of Patent: Jun. 1, 1993

[54] METHOD FOR THE POWDER PACK COATING OF HOLLOW BODIES

[75] Inventors: Michael Strasser, Kleinberghofen; Heinrich Walter, Friedberg; Horst Pillhoefer, Karlsfeld, all of Fed. Rep. of Germany

[73] Assignee: MTU Motoren- und Turbinen- Union Muenchen GmbH, Munich, Fed. Rep. of Germany

[21] Appl. No.: 788,093

[22] Filed: Nov. 5, 1991

[30] Foreign Application Priority Data

Nov. 10, 1990 [DE] Fed. Rep. of Germany ..... 4035790

[51] Int. Cl.[5] ..... B05D 7/22

[52] U.S. Cl. ..... 427/230; 427/235; 427/239; 427/242; 427/252; 427/253; 118/717

[58] Field of Search ..... 427/181, 183, 190, 230, 427/231, 232, 234, 235, 239, 242, 346, 347, 348, 349, 252, 253; 419/9; 118/717

[56] References Cited

U.S. PATENT DOCUMENTS 4,041,196 8/1977 Baldi et al. ..... 427/253
4,156,042 5/1979 Hayman et al. ..... 427/253

FOREIGN PATENT DOCUMENTS 0349420 1/1990 European Pat. Off. .
2411881 9/1975 Fed. Rep. of Germany ..... 427/234
2560523 5/1976 Fed. Rep. of Germany .
1278532 12/1986 U.S.S.R. ..... 427/231

OTHER PUBLICATIONS

"Stahl-Eisen-Pruefblaetter", Number 82-69 (1969) of the Verein Deutscher Eisenhuettenleute.

*Primary Examiner*—Shrive Beck
*Assistant Examiner*—Terry J. Owens
*Attorney, Agent, or Firm*—W. G. Fasse

[57] ABSTRACT

A method for the powder pack coating of hollow structural components is performed with spherical powder particles of a donor metal in which the hollow component is embedded. During the embedding, the component is subjected to a tumbling motion about several spatial axes to fill all cavities in the component. After the powder pack coating process the cavities of the component are cleared of any excess powder particles under the action of a gas stream. This method is suitable especially for coating engine blades having cooling ducts and cooling air holes, such as turbine blades. The effect of the forced air flow through the internal cavities for the removal of excess powder out of the hollow component is enhanced by simultaneously vibrating the component.

8 Claims, 2 Drawing Sheets

METHOD FOR THE POWDER PACK COATING OF HOLLOW BODIES

FIELD OF THE INVENTION

The invention relates to a method for the powder pack coating of hollow bodies, including components having cooling channels therein, such as turbine blades.

BACKGROUND INFORMATION

A method for the powder pack coating of metal objects has been disclosed in German Patent Publication DE 2,560,523. The known method has the disadvantage that it is not suitable for coating internal surfaces inside hollow components, because the metal components to be coated are embedded in a powder packing of donor metal powder enclosing the outside of the components, whereby any connecting ducts between external and internal surfaces are disadvantageously clogged with powder. A uniform internal coating is not ensured, because there is no donor metal in the component's cavities that, after the powder pack coating has been completed, can be removed from the cavities without leaving residues behind. These residues result in a nonuniform coating on the internal surfaces.

To avoid the above problem, gas diffusion coating has been used, as disclosed in EP 0,349,420, for use on hollow components. Solid powder particles do not come into contact with the component where gas diffusion coatings are applied. However, gas diffusion coating methods have the disadvantage that conventional simple powder pack coating devices can no longer be used in mass production operations, so that these coating devices must be replaced by substantially more complex coating systems. Even conventional powder compositions of the donor metal and the heat treatments for the coating process can no longer be used where hollow components of complicated configurations are to be coated on the inside. Additionally, the donor metal gas will deplete on its passage through the cavities of the component being coated, so that the coating thickness disadvantageously becomes dependent upon the length of the flow path of the donor gas through the component.

OBJECTS OF THE INVENTION

In view of the above it is the aim of the invention to achieve the following objects singly or in combination:

- to provide a powder pack method for coating hollow components having complicated configurations, including internal ducts, the surfaces of which must be coated on the inside and outside;
- to provide a powder pack coating method which produces uniform external and internal coating layers on hollow components;
- to make sure that conventional heat treatment parameters the compositions of the powder packings, and the process apparatus can remain substantially unchanged for the present purposes; and
- to provide a powder pack coating method which is especially suitable for uniformly coating engine components, especially turbine blades having intricate cooling channels and bores, so that all external and internal surfaces are provided with a tenaciously adhering coating layer of uniform thickness.

SUMMARY OF THE INVENTION

According to the invention internal surfaces of cavities in hollow structural components, such as turbine blades, are provided with a powder pack coating by the following steps: embedding the hollow component in powder material in a tumbler, said powder material comprising spherical powder particles, the meridional plane of which is maximally one-third of the smallest hollow cross-section of said cavities in said hollow component, said powder material having a flowability which is at least 0.5 g per second through an orifice width of 5 mm, tumbling said tumbler with the embedded hollow component and the powder material about several spatial axes to fill said cavities in said hollow component with said powder material, removing the filled hollow component from the powder material, heat treating the hollow component within a temperature range sufficient for the formation of a coating, for a time duration that depends on the desired thickness of the coating, and then blowing a stream of gas into or through the cavities for removing any excess powder particles from the internal cavities of the hollow component. The external powder pack coating may be applied in a conventional manner prior to, simultaneously with, or subsequent to the internal coating operation. The simultaneous external and internal coating is preferred since it involves the same heat application. For this purpose the filled component that has been removed from the tumbler, is embedded into a powder material conventionally suitable for external powder pack coatings, and exposed to the required heating.

Since the powder particles for the internal coating are spherical and due to their high flowability, the present method affords an advantage in that it permits the filling and clearing of cavities even if these cavities have complex configurations. As mentioned, the flowability should be at least 0.5 g/s through an orifice width of 5 mm in accordance with testing regulations of the "Stahl-Eisen-Pruefblaetter", Number 82-69 (1969) of the "Verein Deutscher Eisenhuettenleute". The tumbling motion about several axes in space during filling assures a complete and uniform distribution of the spherical donor metal particles in all cavities of the component to be coated. In the clearing process, which is assisted by a stream of gas, the spherical particles are completely removed from the cavities of the component, thereby providing clean surfaces inside and also on the outside.

By combining the present preliminary filling procedure and the present excess powder removal step as an after-treatment step, with the heat treatment of a conventional powder pack coating method, the invention provides a method that is quite efficient for industrial applications, including mass production of cover coatings on internal surfaces in hollow structural components.

In a preferred aspect fo the present invention the hollow body is subjected to vibrations when the cavities are being emptied to advantageously accelerate the excess powder removal process which thus employs in combination a gas blowing operation with the vibrating of the component for the excess powder removal. The present method finds a preferred use for the coating of engine blades, more particularly turbine blades with complex cooling ducts and air cooling flow passage configurations. Especially for this use it is important that in accordance with the present invention the meridional plane of a powder particle amounts to maximally one-third of the smallest hollow cross-section of the channels and ducts in the component. This feature makes sure that during powder removal, no powder particles are allowed to remain in the cooling ducts or channel of a blade.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
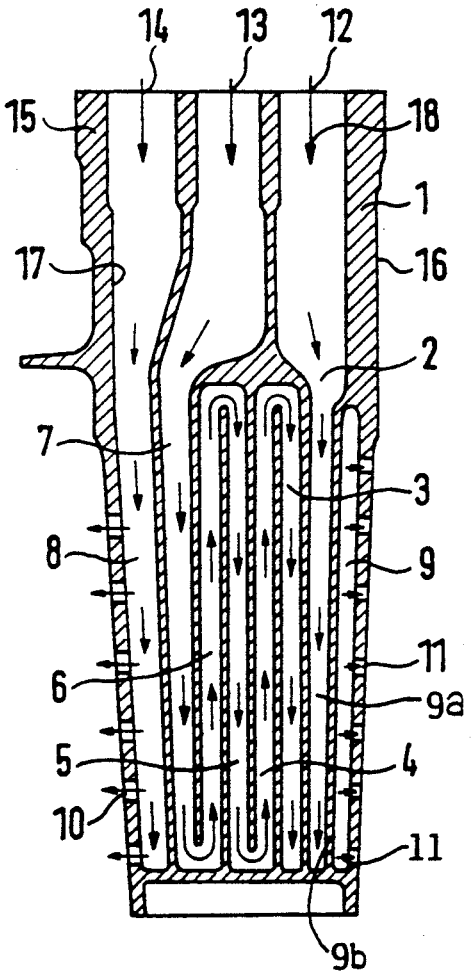
FIG. 1 illustrates a sectional view of a turbine blade having cooling ducts.

With reference first to FIG. 1, a nickel-base alloy turbine blade 1 having cooling ducts 2 to 9, cooling air outlet holes 10 and 11 in the blade body, and cooling air supply ports 12 to 14 in the blade root 15, is to be coated by the powder pack coating technique on its external surfaces 16 and on its internal surfaces 17 to provide a hot gas corrosion protective coating of an aluminum base alloy. Port 12 leads through flow passages 9*a*, 9*b* into duct 9.

Figure 2:
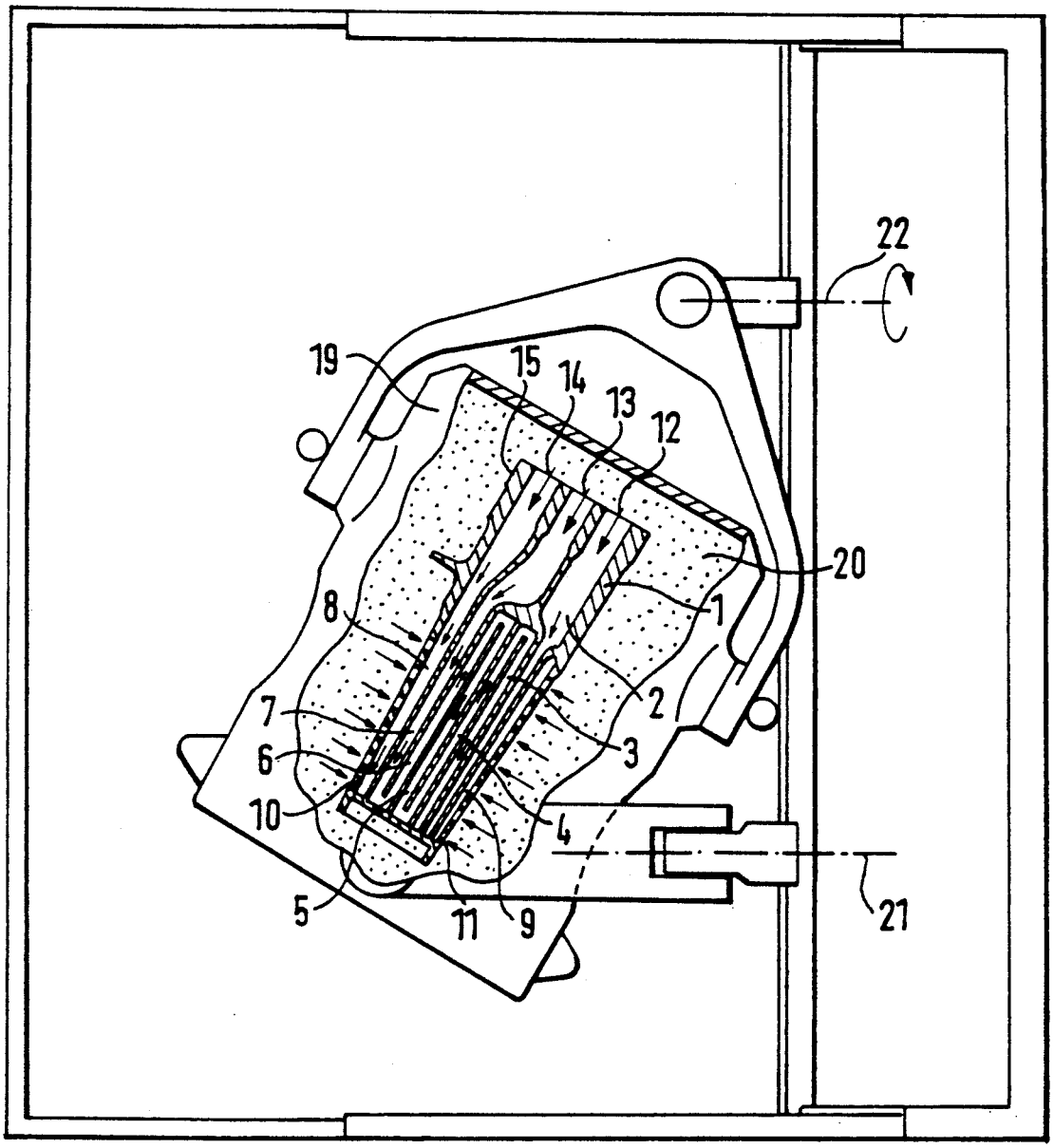
FIG. 2 illustrates a turbine blade with its cooling ducts being filled with donor metal powder in a tumbling apparatus.

For this purpose, the blade 1 is first mounted in a tumbling container 19, as shown in FIG. 2. The container 19 is filled with spherical powder particles 20 having a diameter of maximally 0.08 mm and a flowability of 1 g/s through an orifice width of 5 mm. Rotary motions applied to axes 21 and 22 cause the container 19 to tumble about several spatial axes due to the operation of conventional cam drives not shown. The tumbling motion causes the flowable, spherical powder 20 to penetrate through the ports 12 to 14 into the blade root 15 and through the cooling air holes 10 and 11 into the internal cooling ducts 2 to 9, 9*a*, 9*b*, whereby the respective cavities of the blade are filled with donor metal.

When the cooling ducts 2 to 9 are filled, the turbine blade 1 is taken out of the tumbling container 19 and installed in a powder packing apparatus, exposed to heat within the range of about 700° C. to about 1200° C. for a duration of from about 1.0 hours to about 20.0 hours. The time duration will depend on the required coating thickness.

After the coating process has been completed, excess powder particles are expelled by air blasts introduced into the cooling air holes 10 and 11, while vibrating the blade 1, whereby the combination of the air stream with the vibration assures a surprisingly efficient particle removal. The air flow through the cavities is produced, e.g., by applying negative pressure at the ports 12, 13, and 14.

EXAMPLE FOR AN INTERNAL POWDER PACK COATING OF A TURBINE BLADE

Powder Mixture 80 parts by weight $Al_2O_3$ filler powder material of spherical powder particles with an average particle size of 150 μm, 40 parts by weight donator and activator powder material, donator: AlTi or AlTiC, spherical powder particles, average grain size smaller than 150 μm, activator: NH4F, particle configuration not critical, since in vapor form at the coating temperature.

Coating Temperature: 1060° C.

Coating Duration: 4 hours

Coating Layer Thickness: 35 to 50 μm

Reaction Atmosphere: contained hydrogen.

Although the invention has been described with reference to specific example embodiments, it will be appreciated that it is intended to cover all modifications and equivalents within the scope of the appended claims.

What we claim is:

1. A method for powder pack coating internal cavity surfaces of a hollow component having internal flow passages therein, comprising the following steps:

(a) selecting a donor powder material having spherical powder particles, the meridional plane of which is maximally one-third of the smallest hollow cross-section of said flow passages in said hollow component, said donor powder material further having a flowability which is at least 0.5 grams per second through an orifice width of 5 mm, (b) embedding said hollow component in said donor powder material inside a tumbling device, (c) tumbling said tumbling device with the hollow component embedded in said donor powder material by repeatedly tilting about several spatial axes to fill any cavities inside said hollow component to form a powder filled hollow component, (d) removing said powder filled hollow component from said tumbling device and out of said donor powder material, (e) exposing said powder filled component to a heat treatment and (f) emptying said cavities under the action of a gas stream by blowing excess powder particles out of said cavities.

2. The method of claim 1, further comprising vibrating said hollow component while said cavities are being emptied, whereby said blowing and vibrating take place simultaneously for an effective removal of excess powder particles.

3. The method of claim 1, applied to hollow components of complex configuration.

4. The method of claim 1, wherein said heat treatment is performed at a temperature within the range of 700° C. to 1200° C., for a duration within the range of about one hour to about 20 hours.

5. The method of claim 4, wherein said heat treatment is stopped when a powder pack coating has been formed having a thickness within the range of 20 μm to 80 μm.

6. The method of claim 1, further comprising again embedding said powder filled hollow component in a powder material and then performing said heat treatment, whereby said coating of said internal cavity surfaces and of any embedded external component surfaces take place simultaneously.

7. The method of claim 1, comprising applying an external powder pack coating to said hollow component prior to said embedding step.

8. The method of claim 1 comprising applying an external powder pack coating to said hollow component subsequent to said blowing step.

* * * * *